US006152439A

United States Patent [19]

Hirayama et al.

[11] Patent Number: 6,152,439

[45] Date of Patent: Nov. 28, 2000

[54] COLLATOR SYSTEM HAVING SHEET FEEDING ERROR DISPLAY FUNCTION

[75] Inventors: Hisahiro Hirayama, Shiga; Eiji Katayama, Kyoto, both of Japan

[73] Assignee: Horizon International, Inc., Shiga, Japan

[21] Appl. No.: 09/340,161

[22] Filed: Jun. 28, 1999

[30] Foreign Application Priority Data

Jul. 1, 1998 [JP] Japan ..... 10-185858

[51] Int. Cl.[7] ..... B24B 2/00; B24B 2/02; B65H 39/00; B65H 39/02; B65H 41/00

[52] U.S. Cl. ..... 270/52.04; 270/52.01; 270/52.06

[58] Field of Search ..... 270/30.01, 30.02, 270/52.01, 52.04, 52.06, 58.01, 58.03

[56] References Cited

U.S. PATENT DOCUMENTS 5,125,635 6/1992 Iwabuchi ..... 270/56

*Primary Examiner*—Donald P. Walsh
*Assistant Examiner*—Jonathan R. Miller
*Attorney, Agent, or Firm*—Armstrong, Westerman, Hattori, McLeland & Naughton

[57] ABSTRACT

The present invention provides a collator system comprising a sheet collating device (1*a*) in which a plurality of sheet supply shelves (2*a*–2*h*) are provided, a stack of sheets to be collated are supported on each sheet supply shelf (2*a*–2*h*), the sheets are fed one by one from each sheet supply shelf to a collating section (6*a*) for each collating operation and one sheet bundle is thus collated, a sheet loading device (21) for receiving the sheet bundle collated from the sheet collating device (1*a*), a controller (14) for controlling operations of the sheet collating device (1*a*) and the sheet loading device (21), a sheet feeding error detecting section provided on each sheet supply shelf of the sheet collating device (1*a*), and a sheet feeding error display unit (17) connected to the controller. When the sheet feeding errors are detected by the sheet feeding error detecting section, the controller (14) outputs a stop signal to the sheet collating device (1*a*) and continues the collating operation which is being performed during the sheet feeding error detection but stops the collating operation to be started after the sheet feeding error detection, and displays, by switching, the sheet supply shelf where the sheet feeding errors occur and the contents of the sheet feeding errors on the same display screen of the sheet feeding error display unit (17) for each collating operation performed after the stop signal is output and before the collating operation of the sheet collating device (1*a* to 1*n*) is completely ended.

6 Claims, 8 Drawing Sheets

COLLATOR SYSTEM HAVING SHEET FEEDING ERROR DISPLAY FUNCTION

BACKGROUND OF THE INVENTION

The present invention relates to a collator system having a sheet feeding error display function.

There has conventionally been known a collator system comprising a sheet collating device for collating a plurality of printed sheets in order of pages and a sheet loading device for receiving a collated sheet bundle sequentially discharged from the sheet collating device.

FIG. 10 is a schematic side view showing an example of such a collator system. A sheet collating device 1 comprises sheet supply shelves 2*a* to 2*h* having 8 stages in a longitudinal direction. A predetermined number of sheets having the same page are housed in each of the sheet supply shelves 2*a* to 2*h*. Sheet feeding rollers 3*a* to 3*h* are provided on the sheet feeding side of each of the sheet supply shelves 2*a* to 2*h*. Sheets P1 to P8 discharged from the sheet supply shelves 2*a* to 2*h* by means of the sheet feeding rollers 3*a* to 3*h* are fed to a longitudinal delivery belt 6 through longitudinal delivery rollers 4*a* to 4*h*.

The longitudinal delivery belt 6 is driven by driving rollers 5*a* and 5*b* for the longitudinal delivery belt which are provided at intervals in a vertical direction. The sheets fed from the sheet supply shelves 2*a* to 2*h* to the longitudinal delivery belt 6 are sequentially stacked and collated in order of pages while they are being delivered downward in the vertical direction. Thus, a sheet bundle for one volume is formed.

A horizontal and transverse delivery belt 8 is provided in a position spaced from the lower end of the longitudinal delivery belt 6. The transverse delivery belt 8 is driven by driving rollers 7*a* and 7*b* for the transverse delivery belt provided at an interval in the horizontal direction.

The collated sheet bundle is transferred from the lower end of the longitudinal delivery belt 6 to the transverse delivery belt 8 through a guide plate 10. A sheet discharging roller 9*a* is provided in an end on the sheet discharging port 11 side of the transverse delivery belt 8. The sheet bundle is sent into the sheet discharging port 11 through the sheet discharging roller 9*a*. The reference numeral 9*b* denotes a delivery roller for delivering the sheet bundle supplied from another sheet collating device to the transverse delivery belt 8 when a plurality of sheet collating devices are coupled for use. The sheet bundle discharged from the discharge port 11 is supplied to the sheet loading device 21 through a coupling plate 13.

For the sheet supply shelves 2*a* to 2*h*, sensors 12*a* to 12*h* are provided in sheet feeding paths for the sheets P1 to P8 between the sheet feeding rollers 3*a* to 3*h* and the longitudinal delivery rollers 4*a* to 4*h*. The sensors 12*a* to 12*h* are made of light transmission type sensors, for example. Detection signals of the sensors 12*a* to 12*h* are input to a controller 14. The detection signals are used for deciding sheet feeding errors (missing sheets, double sheets and the like). A sensor for detecting multiple sheets is provided on each of the sheet supply shelves 2*a* to 2*h* in the vicinity of the sheet feeding rollers 3*a* to 3*h*. The signal of the sensor is also input to the controller 14. The controller 14 serves to output a control signal to each of drive mechanisms such as the sheet feeding rollers 3*a* to 3*h* of the sheet collating device, and to control these drive mechanisms.

A display unit 16 is mounted in a position on the side face of the sheet collating device 1 or the like that an operator can see, and serves to display sheet feeding errors of the sheet supply shelves 2*a* to 2*h*. The display unit 16 is connected to the controller 14 by means of a cable 15. FIG. 11 is a plan view showing an example of the display unit 16. The display unit 16 has a base 16*a*. A first display section 16*b* indicative of the contents of the sheet feeding errors by marks is provided on the base 16a. In the drawing, (I), (II) and (III) are marks indicating multiple sheets, missing sheets and double sheets, respectively.

The reference numeral 16*c* denotes a second display section for displaying the sheet supply shelves by number from the top in order, and the reference numerals 16*d* to 16*f* denote a display lamp using a light emitting diode (LED) or the like. The display lamps 16*d* to 16*f* are provided in a matrix corresponding to the first display section 16*b* and the second display section 16*c*. In the display unit 16 shown in FIG. 11, a display lamp X is turned on to indicate that sheet feeding errors of the multiple sheets occur in a seventh sheet supply shelf.

In the conventional collator system, thus, the sheet feeding error display unit of each sheet supply shelf requires a large number of display lamps. Consequently, there has been a problem in that a manufacturing cost is increased and a large space is also greatly required for the installation of the display unit. In particular, in the case where a plurality of sheet collating devices are coupled for use in order to collate a sheet bundle having a large number of pages, the display lamp having the above-mentioned structure is required for each sheet collating device. Therefore, the cost is further increased. Consequently, an increase in the size of the display unit cannot be avoided.

SUMMARY OF THE INVENTION

Accordingly, it is an object of the present invention to provide a collator system which comprises a display unit for displaying sheet feeding errors that has a small size and is inexpensive and which can properly cope with sheet feeding errors also in the case where a sheet collating device operates at a high speed.

In order to achieve the above-mentioned object, the present invention provides a collator system having a sheet feeding error display function, comprising a sheet collating device in which a plurality of sheet supply shelves are provided, a stack of sheets to be collated are supported on each sheet supply shelf, the sheets are fed one by one from each sheet supply shelf to a collating section for each collating operation and one sheet bundle is thus collated, a sheet loading device for receiving the sheet bundle collated from the sheet collating device, a controller for controlling operations of the sheet collating device and the sheet loading device, sheet feeding error detecting means provided on each sheet supply shelf of the sheet collating device, and a sheet feeding error display unit connected to the controller, wherein when sheet feeding errors are detected by the sheet feeding error detecting means, an error detection signal is output from the sheet feeding error detecting means to the controller so that the controller outputs a stop signal to the sheet collating device and causes the sheet feeding error display unit to operate, and when the sheet feeding errors are detected by the sheet feeding error detecting means, the controller outputs the stop signal to the sheet collating device and continues the collating operation which is being performed during the sheet feeding error detection but stops the collating operation to be started after the sheet feeding error detection, and displays, by switching, the sheet supply shelf where the sheet feeding errors occur and the contents of the sheet feeding errors on the same display screen of the sheet feeding error display unit for each collating operation performed after the stop signal is output and before the collating operation of the sheet collating device is completely ended.

The present invention provides the collator system having a sheet feeding error display function, wherein a plurality of sheet collating devices are coupled, one sheet bundle is collated by a series of the sheet collating devices and is transferred to the sheet loading device for each collating operation, and when the sheet feeding errors are detected, the controller displays, by switching, the sheet collating device and sheet supply shelf where the sheet feeding errors occur and the contents of the sheet feeding errors on the same display screen of the sheet feeding error display unit for each collating operation performed after the stop signal is output and before the collating operations of the series of sheet collating devices are completely ended.

Furthermore, the present invention provides the collator system having a sheet feeding error display function, wherein a sheet feeding mechanism including a sheet feeding roller is provided between the sheet supply shelf and the collating section in the sheet collating device, the sheet feeding error detecting means comprising a sensor provided in the vicinity of the sheet feeding roller for detecting the sheet passing through the sheet feeding roller and for generating a sheet detection signal while the sheet passes through the sheet feeding roller, a pulse generator for generating a series of clock pulses according to a sheet feeding operation of the sheet feeding mechanism, a counter for counting the number of pulses generated by the pulse generator for the collating operation, a comparator for generating a detection timing signal when the counter counts a pulse number which is greater than a preset pulse number, and a detector for outputting an error detection signal based on the sheet detection signal sent from the sheet feeding sensor and the detection timing signal sent from the comparator, and the controller comprising a CPU, and a memory for recording sheet feeding error information for each collating operation which is performed after the stop signal is output and before the collating operation of the sheet collating device is completely ended based on the error detection signal sent from the detector.

Moreover, the present invention provides a collator system having a sheet feeding error display function, comprising a sheet collating device in which a plurality of sheet supply shelves are provided, a stack of sheets to be collated are supported on each sheet supply shelf, the sheets are fed one by one from each sheet supply shelf to a collating section for each collating operation and one sheet bundle is thus collated, a sheet loading device including a sheet bundle feeding port and a sheet bundle receiving section for loading sheet bundles and serving to deliver the sheet bundles sequentially fed from the sheet collating device to the sheet bundle feeding port to the sheet bundle receiving section through a delivery path, a controller for controlling operations of the sheet collating device and the sheet loading device, sheet feeding error detecting means provided on each sheet supply shelf of the sheet collating device, and a sheet feeding error display unit connected to the controller, wherein when sheet feeding errors are detected by the sheet feeding error detecting means, an error detection signal is output from the sheet feeding error detecting means to the controller so that the controller causes the sheet feeding error display unit to operate, and wherein the sheet loading device further includes an erroneous collated sheet discharging tray, the delivery path has a main delivery path section extending from the sheet feeding port to a branch point, a first delivery path section extending from the branch point to the sheet bundle receiving section, and a second delivery path section extending from the branch point to the erroneous collated sheet discharging tray, the branch point is provided with a switching gate plate for operating in such a manner that the main delivery path section is selectively connected to the first delivery path section or the second delivery path section, the controller causes the switching gate plate to operate in such a manner that the main delivery path section is connected to the first delivery path section while sheets are normally fed, and causes the switching gate plate to operate in such a manner that the main delivery path section is connected to the second delivery path section when sheet feeding errors are detected by the sheet feeding error detecting means, and the controller further displays, by switching, the sheet supply shelf where the sheet feeding errors occur and the contents of the sheet feeding errors on the same display screen of the sheet feeding error display unit for each sheet bundle loaded on the erroneous collated sheet discharging tray.

Furthermore, the present invention provides the collator system having a sheet feeding error display function, wherein a plurality of sheet collating devices are coupled, one sheet bundle is collated by a series of the sheet collating devices and is transferred to the sheet loading device for one collating operation, and the controller displays, by switching, the sheet collating device and sheet supply shelf where the sheet feeding errors occur and the contents of the sheet feeding errors on the same display screen of the sheet feeding error display unit for each sheet bundle loaded on the erroneous collated sheet discharging tray.

Moreover, the present invention provides the collator system having a sheet feeding error display function, wherein a sheet feeding mechanism including a sheet feeding roller is provided between the sheet supply shelf and the collating section in the sheet collating device, the sheet feeding error detecting means comprising a sensor provided in the vicinity of the sheet feeding roller for detecting the sheet passing through the sheet feeding roller and for generating a sheet detection signal while the sheet passes through the sheet feeding roller, a pulse generator for generating a series of clock pulses according to a sheet feeding operation of the sheet feeding mechanism, a counter for counting the number of pulses generated by the pulse generator for the collating operation, a comparator for generating a detection timing signal when the counter counts a pulse number which is greater than a preset pulse number, and a detector for outputting an error detection signal based on the sheet detection signal sent from the sheet feeding sensor and the detection timing signal sent from the comparator, and the controller comprising a CPU, and a memory for recording sheet feeding error information based on the error detection signal sent from the detector.

DETAILED DESCRIPTION OF THE PREFERRED EMBODIMENTS

Figure 5:
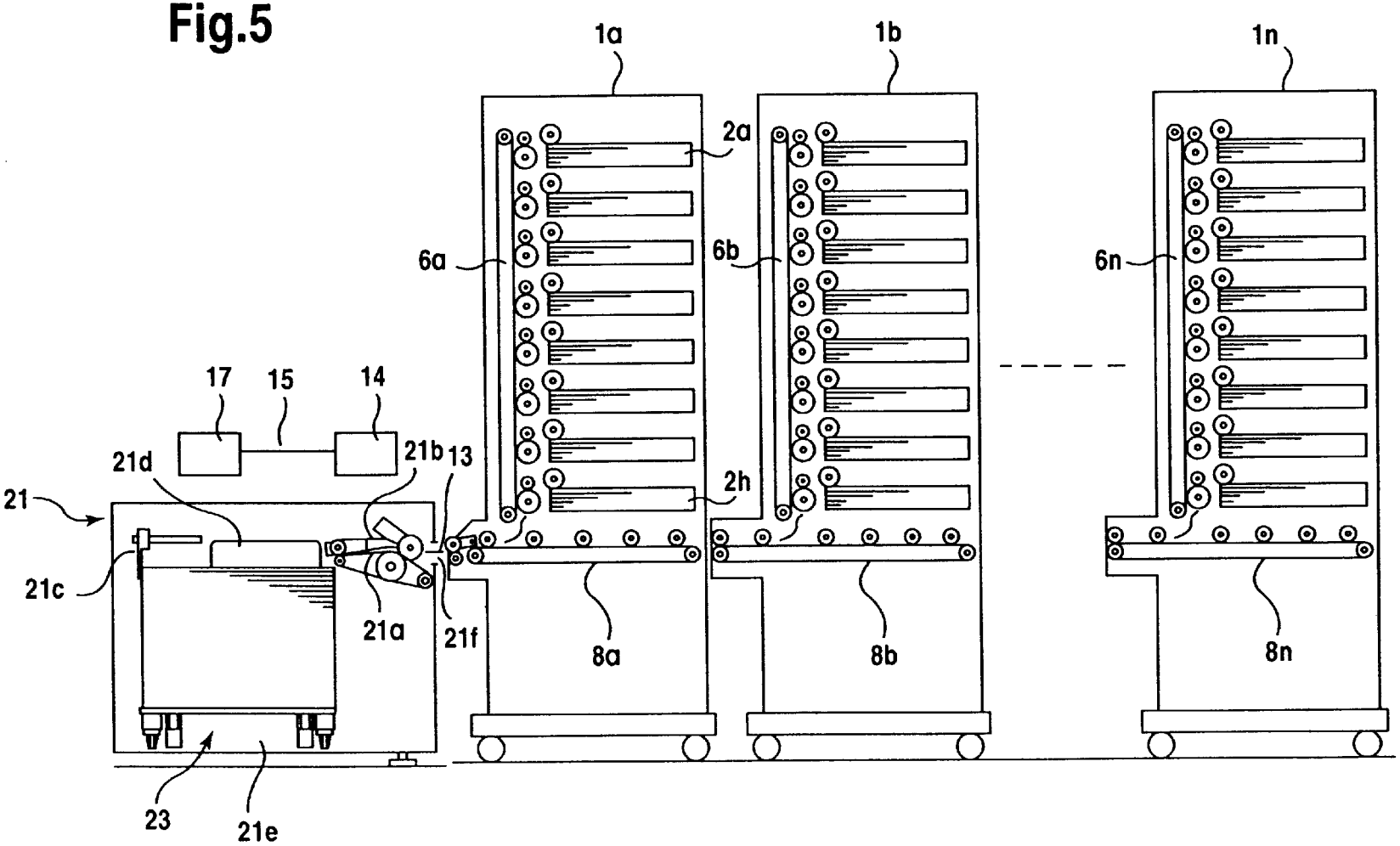
FIG. 5 is a schematic side view showing the collator system according to the embodiment of the present invention.

FIG. 5 is a schematic side view showing a collator system according to an embodiment of the present invention. As shown in FIG. 5, the collator system according to the present invention comprises n sheet collating devices 1*a* to 1*n* which are coupled, and a sheet loading device 21 for receiving a collated sheet bundle from the sheet collating devices 1*a* to 1*n*. The sheetet collating devices 1*a* to 1*n* include sheet supply shelves 2*a* to 2*h* having eight stages, and have the same structure as that of the sheet collating device shown in FIG. 10. The structures of the sheet collating devices 1*a* to 1*n* will not be described in detail.

A stack of sheets to be collated is supported on each of the sheet supply shelves of the sheet collating devices 1*a* to 1*n*. For one collating operation, a sheet is fed one by one from each of the sheet supply shelves of the sheet collating devices 1*a* to 1*n* to collating sections 6*a* to 6*n*, and sets of the collated sheets which are formed for each sheet collating device are sequentially stacked. Consequently, one sheet bundle is collated and is transferred to the sheet loading device 21. More specifically, one sheet bundle is collated by a series of sheet collating devices 1*a* to 1*n* and is fed to the sheet loading device 21 for one collating operation.

The sheet loading device 21 includes a sheet bundle feeding port 21*f*, and a sheet bundle receiving section 23 having a sheet bundle receiver 21*e* for loading sheet bundles. The sheet bundles sequentially fed from the sheet collating devices 1*a* to in to the sheet bundle feeding port 21*f* is delivered to the sheet bundle receiving section 23 through a delivery path 21*a*.

Figure 9:
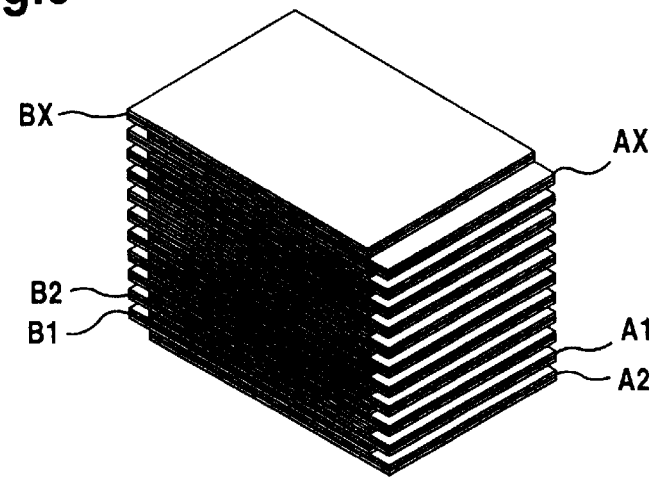
FIG. 9 is a perspective view showing an example of a sheet bundle loaded on a sheet bundle receiver.

Furthermore, a sorting mechanism 21*d* is fixed to the sheet bundle receiving section 23. The sorting mechanism 21*d* serves to sort the sheet bundles by alternately shifting the sheet bundles sequentially delivered to the sheet bundle receiving section 23 to the right and left with respect to the delivery direction. In FIG. 5, the reference numeral 21*c* denotes a stopper for aligning the ends of the sheet bundles delivered to the sheet loading section 21 and for loading them. FIG. 9 shows the state of the sheet bundles thus sorted and loaded on the sheet bundle receiver 21*e*. In FIG. 9, the ends of the sheets are aligned for each sheet bundle, and the sheet bundles are sorted into two sets in which the ends make a line of A1 to AX and a set in which the ends make a line of B1 to BX. By alternately shifting and loading the sheet bundles, thus, a work for separately sorting the sheet bundles is not required when a next processing step such as filing is to be performed. Accordingly, there is an advantage that bookbinding can be rapidly carried out. The sorting mechanism 21*d* is attached to the sheet loading device 21 if necessary.

The operations of the sheet collating devices 1*a* to 1*n* and the sheet loading device 21 are controlled by a controller 14.

Figure 6:
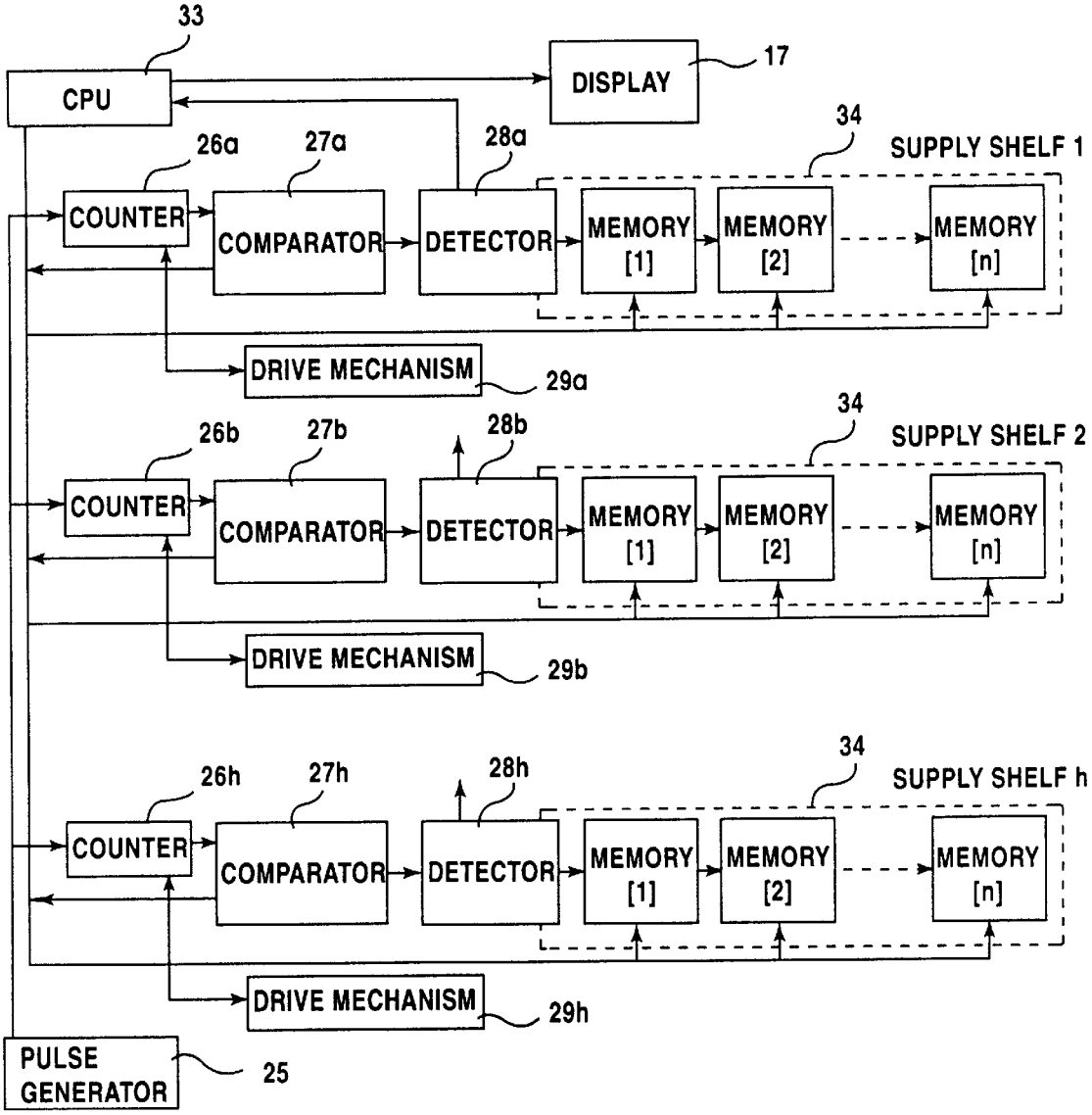
FIG. 6 is a block diagram showing the schematic structure of a feeding sheet error detecting section of the collator system illustrated in FIG. 5.

A sheet feeding error detecting section is provided on each sheet supply shelf of the sheet collating device. The sheet feeding error detecting section has the same structure in any sheet collating device. FIG. 6 is a block diagram showing the schematic structure of the sheet feeding error detecting section provided in one sheet collating device.

Figure 10:
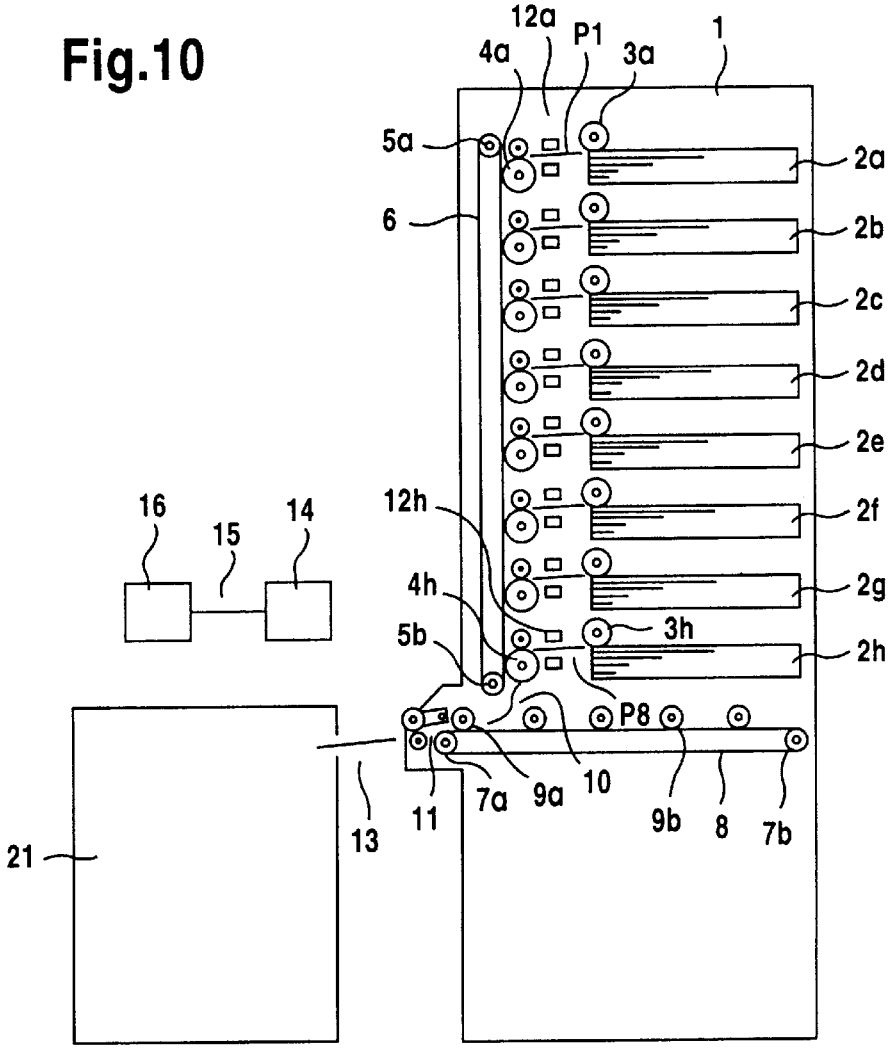
FIG. 10 is a schematic side view showing a collator system according to the prior art.
Figure 11:
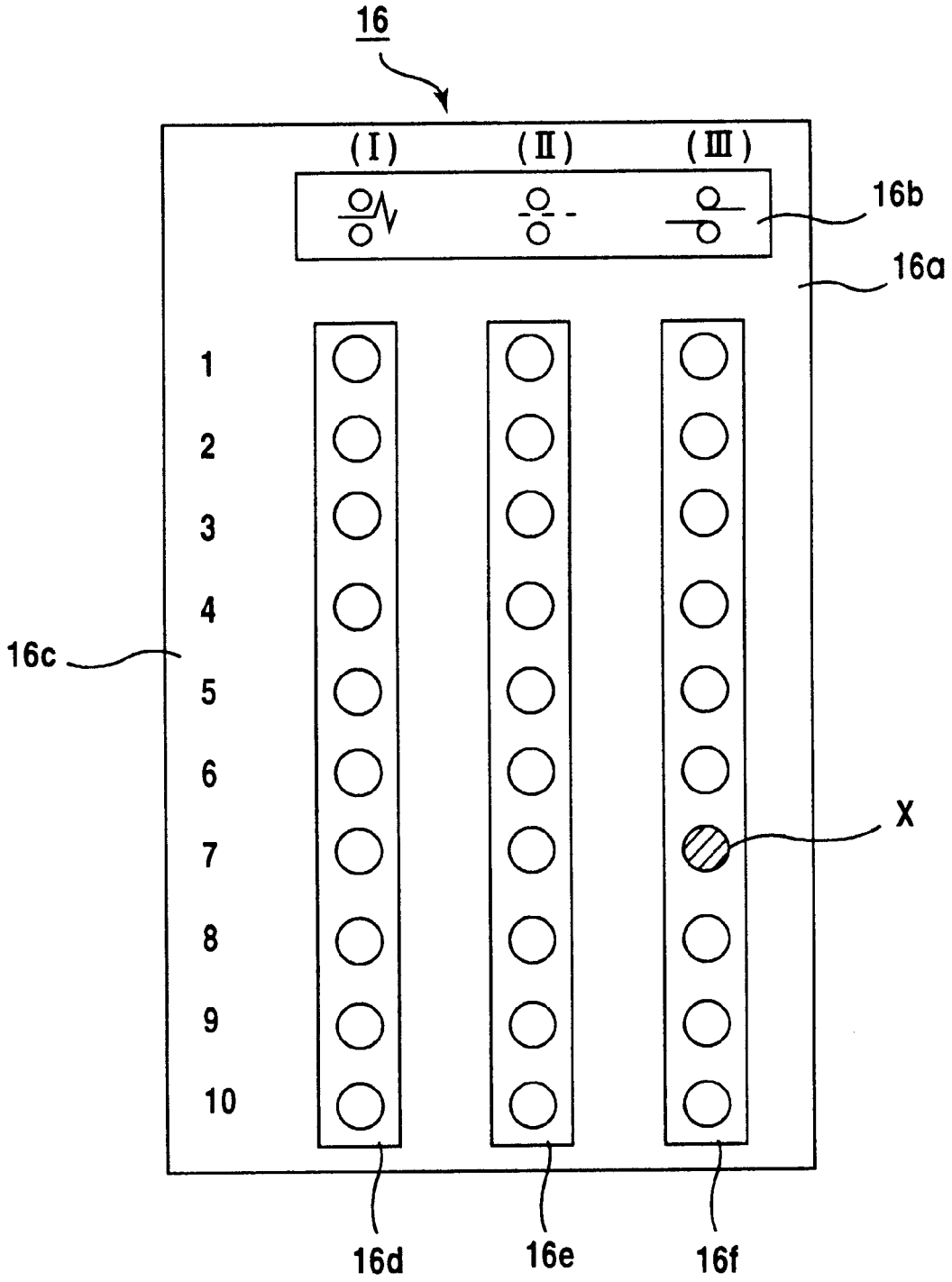
FIG. 11 is a schematic plan view showing a display unit of the collator system according to the prior art.

As shown in FIG. 6, the sheet feeding error detecting section has a sensor (see the reference numerals 12*a* to 12*h* in FIG. 10) provided in the vicinity of each sheet feeding roller (see the reference numerals 4*a* to 4*h* in FIG. 10). The sensor serves to detect the sheets passing through the sheet feeding roller and to generate a sheet detection signal while the sheets pass through the sheet feeding roller. The sheet feeding error detecting section further has a single pulse generator 25 for generating a series of clock pulses according to the sheet feeding operation of each sheet feeding roller, counters 26*a* to 26*h* for counting the number of pulses generated by the pulse generator 25 for each collating operation, comparators 27*a* to 27*h* for generating a detection timing signal when the counters 26*a* to 26*h* count the pulse number which is greater than a predetermined pulse number, and detectors 28*a* to 28*h* for outputting an error detection signal based on the sheet detection signal sent from the sensor and the detection timing signals sent from the comparators 27*a* to 27*h*.

The controller 14 has a CPU 33, and a memory 34 for recording sheet feeding error information based on the error detection signals sent from the detectors 28*a* to 28*h*.

In FIG. 6, the reference numerals 29*a* to 29*h* denote drive mechanisms for driving the sheet feeding roller.

Figure 1:
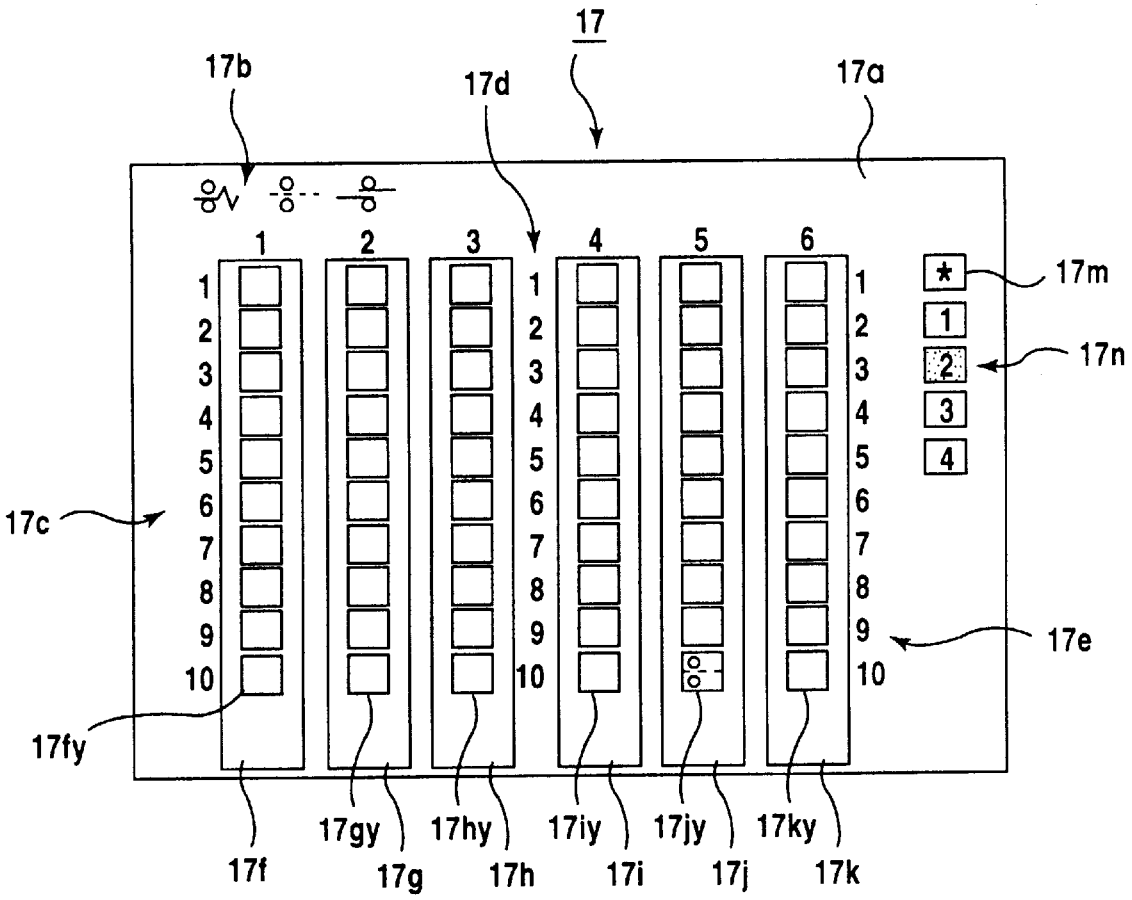
FIG. 1 is a schematic plan view showing a display unit for a collator system according to an embodiment of the present invention.

For example, the display unit 17 is attached to the side face of the sheet collating device 1*a* positioned most closely to the sheet loading device 21, and is connected to the controller 14 through a cable 15. FIG. 1 is a plan view showing the schematic structure of the display unit 17. In FIG. 1, the reference numeral 17*a* denotes a base, and the reference numeral 17*b* denotes a display region for explaining marks displaying the contents of sheet feeding errors, that is, multiple sheets, missing sheets and double sheets. The reference numerals 17*c* to 17*e* denote a display region for displaying, by number, a position from the top stage of the sheet supply shelf. The reference numerals 17*f* to 17*k* denote display panels disposed for the sheet collating devices 1 to 6 which are provided with display lamps 17*fy* to 17*ky* corresponding to the sheet supply shelves. The display lamps 17*fy* to 17*ky* display marks corresponding to the contents of the sheet feeding errors. The sheet collating devices have numbers 1 to 6 in order from the closest position from the sheet loading device 21. The reference numeral 17*m* denotes a display lamp for informing the generation of the sheet feeding errors. The reference numeral 17*n* denotes an operating switch to be used when the contents of the sheet feeding errors are to be displayed. The operation of the operating switch 17*n* will be described below.

The embodiment shown in FIG. 1 illustrates a structure in which sheet feeding errors can be displayed when the sheet supply shelf for each sheet collating device has a maximum of 10 stages and a maximum of ten sheet collating devices are provided, and can cope with the case where the number of the stages of the sheet supply shelf and the number of the sheet collating devices to be coupled are within this range.

The collating operation is started by sending a sheet feeding start signal from the CPU 33 to the sheet feeding roller drive mechanism 29*h* of the sheet supply shelf provided in the uppermost stage of the sheet collating device 1*n* which is the farthest from the sheet loading device 21. The sheets fed from the sheet supply shelf are detected by the sensor provided immediately behind the sheet feeding roller. While the sheet is passing through the sensor, the sheet detection signal is output from the sensor.

After the counters 26*a* to 26*h* are reset in response to the sheet feeding start signal, they count, as clock pulses, the pulses generated from the pulse generator 25.

When the contents 26*a* to 26*h* count pulses equivalent to a longer time than required for the normal sheet feeding, detection timing signals are sent from the comparators 27*a* to 27*h* to the detectors 28*a* to 28*h*. Consequently, the detectors 28*a* to 28*h* operate to detect the generation of the missing sheets, the double sheets or the multiple sheets.

For example, if the sheet is not detected by the sensor before the detection timing signals are sent to the detectors 28*a* to 28*h*, the generation of the missing sheets is detected. When the detection timing signals are sent to the detectors 28*a* to 28*h*, the generation of the multiple sheets is detected if the sensor detects the sheet. When the detection timing signals are sent to the detectors 28*a* to 28*h*, the sensor detects the amount of transmitted light of the sheet so that the generation of the double sheets can be detected.

After the detection timing signal, the comparators 27*a* to 27*h* send postprocessing timing signals to the detectors 28*a* to 28*h* upon receipt of the next clock pulse. The detectors 28*a* to 28*h* are triggered by the postprocessing timing signals, and output a detection end signal to the CPU 33. Consequently, the sheet feeding start signal is erased.

When the sheet feeding errors are detected by the sheet feeding error detecting section, the CPU 33 continues the sheet feeding start signal which has already been output when the sheet feeding errors are detected and locks the output of the sheet feeding start signal after the sheet feeding errors are detected (the output of a stop signal). As a result, although the collating operation which is being performed during the sheet feeding error detection is continued, the collating operation to be started after the sheet feeding error detection is stopped.

Then, the sheet feeding start signal for the next sheet feeding operation is output from the CPU 33 after a constant standby time.

When the sheet feeding errors are detected, the display lamp 17*m* of the display unit 17 is turned on in response to the signal sent from the controller 14 and the operator is informed of the generation of the sheet feeding errors.

The operating switch 17*n* shown in FIG. 1 serves to decide the contents of the sheet feeding errors for the sheet bundles collated after the sheet feeding errors are generated and before the sheet collating device is completely stopped. The present embodiment can correspond to the case where the collating operation is performed at a maximum of four times from the generation of the sheet feeding errors to the stop of the sheet collating device.

The operating switch 17*n* having the numbers 1 to 4 correspond to the sheet bundles loaded on the sheet bundle receiver 21*e*, respectively. More specifically, the operating switch 17*n* having the number 1 corresponds to the sheet bundle in the uppermost position, and the operating switch 17*n* having the number 4 corresponds to the sheet bundle in the lowermost position. In FIG. 1, the operating switch 17*n* having the number 2 is operated.

When the operator operates the operating switch 17*n*, the controller 14 decides the presence and contents of the sheet feeding errors of the corresponding sheet bundle and outputs a signal to the display unit 17. In FIG. 1, for the sheet bundles loaded on the sheet bundle receiving section by the third collating operation after the stop signal is output, it is displayed that the missing sheets are generated in the sheet supply shelf having a tenth stage of the fifth sheet collating device.

The operator can take proper countermeasures such as supplement of sheets for the sheet bundle, removal of the double sheets and the like depending on the contents of the sheet feeding errors.

Since the display unit shown in FIG. 1 displays, by switching, sheet feeding error information on the same display screen for each collating operation when the sheet feeding errors occur, it can have a smaller structure as compared with the conventional structure and a cost can also be reduced. Furthermore, the sheet feeding errors of the sheet bundles loaded in the sheet loading device are displayed after the sheet feeding errors are generated and before the sheet collating device is stopped. Therefore, the display unit can cope with an increase in the processing speed of the sheet collating device and it is possible to avoid a situation in which the sheet bundles having sheet feeding errors are subjected to a bookbinding process.

The display unit shown in FIG. 1 is not intended for only the case where a plurality of sheet collating devices are coupled but can also be applied to the case where a single sheet collating device is used.

According to the embodiments shown in FIGS. 1 and 5, when the sheet feeding errors are generated, the operation of the sheet collating device is once stopped so that the sheet bundle having sheet feeding errors loaded on the sheet loading device is removed, thereby performing process according to the contents of the sheet feeding errors. Consequently, the use efficiency of the sheet collating device is deteriorated.

Figure 7:
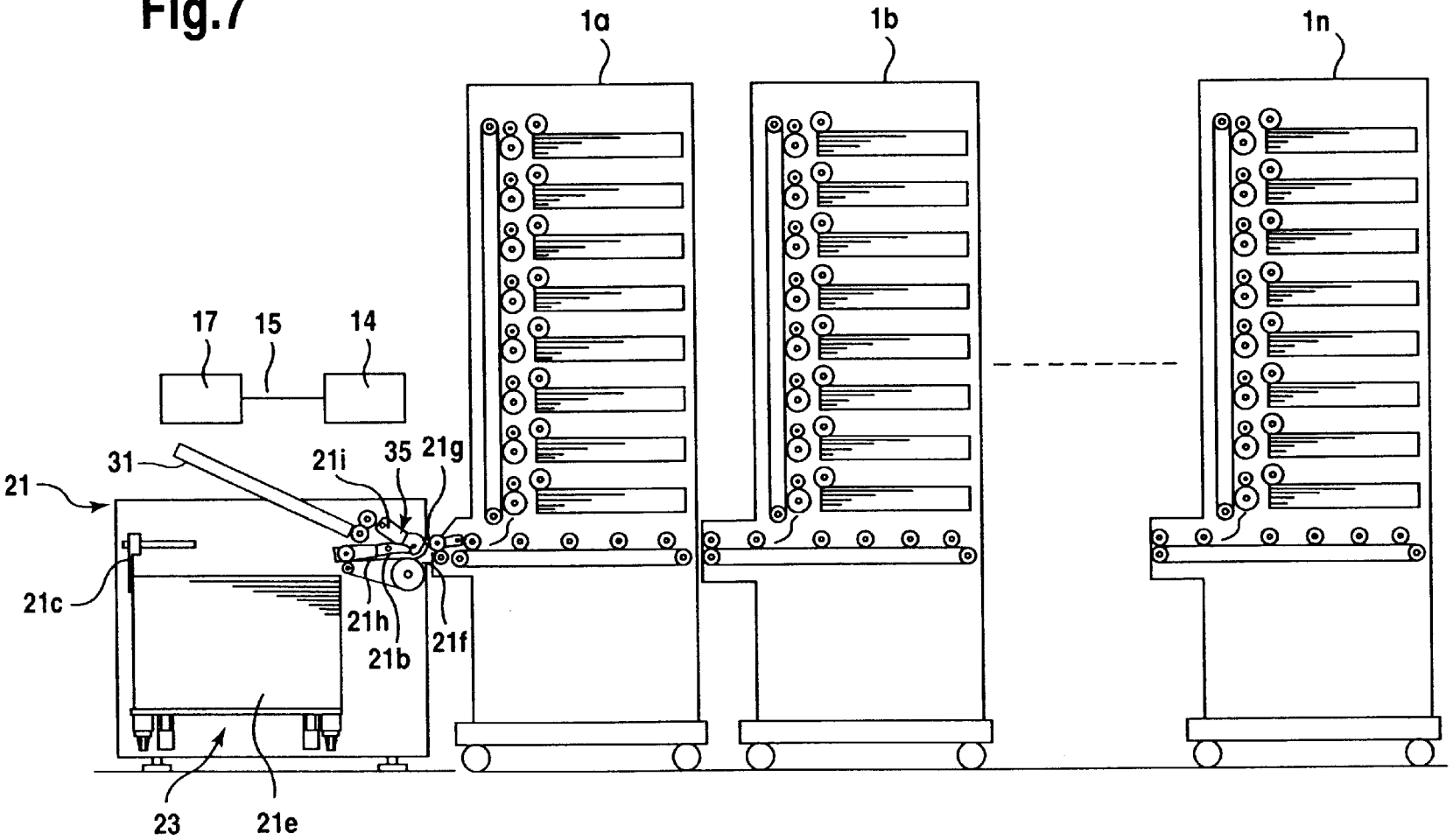
FIG. 7 is a schematic side view showing a collator system according to another embodiment of the present invention.

The above-mentioned problem is solved by the embodiment shown in FIG. 7. In FIG. 7, components corresponding to FIG. 5 have the same reference numerals and detailed description will be omitted. In the embodiment shown in FIG. 7, the sheet loading device 21 further includes an erroneous collated sheet discharging tray 31. In addition, the delivery path 12*a* has a main delivery path section 21*g* extending from a sheet feeding port 21*f* to a branch point 35, a first delivery path section 21*h* extending from the branch point 35 to a sheet bundle receiving section 23, and a second delivery path section 21*i* extending from the branch point 35 to an erroneous collated sheet discharging tray 31. A switching gate plate 21*b* for operating to selectively connect the main delivery path section 21*g* to the first delivery path section 21*h* or the second delivery path section 21*i* is provided on the branch point 35.

Figure 2:
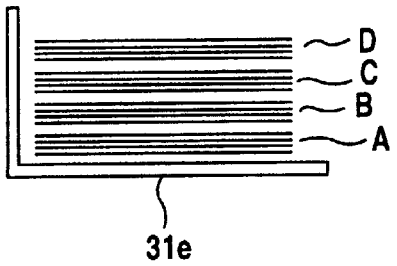
FIG. 2 is a side view showing an erroneous collated sheet discharging tray in which a sheet bundle having sheet feeding errors is loaded.

The controller 14 causes the switching gate plate 21*b* to operate in such a manner that the main delivery path section 21*g* is connected to the first delivery path section 21*h* while normal sheet feeding is performed. When the sheet feeding errors are detected by the sheet feeding error detecting section, the main delivery path section 21*g* causes the switching gate plate 21*b* to operate in such a manner that the main delivery path section 21*g* is connected to the second delivery path section 21*i*. Accordingly, even if the sheet feeding errors are generated, the sheet collating devices 1*a* to 1*n* continue the collating operation without stop. Thus, only sheet bundles A, B, C, . . . having sheet feeding errors are sequentially loaded on the erroneous collated sheet discharging tray 31 as shown in FIG. 2.

In the present embodiment, the sorting mechanism is removed.

The controller 14 further displays, by switching, the sheet supply shelf in which the sheet feeding errors are generated and the contents of the sheet feeding errors on the same display screen of the sheet feeding error display unit 17 for each sheet bundle loaded on the erroneous collated sheet discharging tray 31.

When a proper number of sheet bundles are loaded on the erroneous collated sheet discharging tray 31, the operator decides the contents of the sheet feeding errors for each loaded sheet bundle based on the display of the display unit 17 to execute a suitable process such as addition of insufficient sheets.

Figure 3:
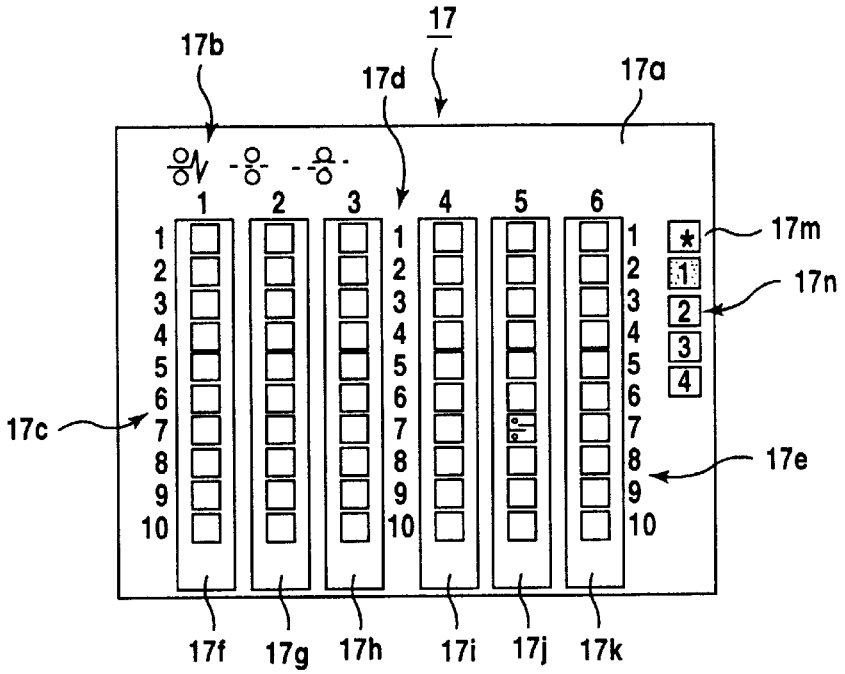
FIG. 3 is a schematic plan view showing another example of the display unit.
Figure 4:
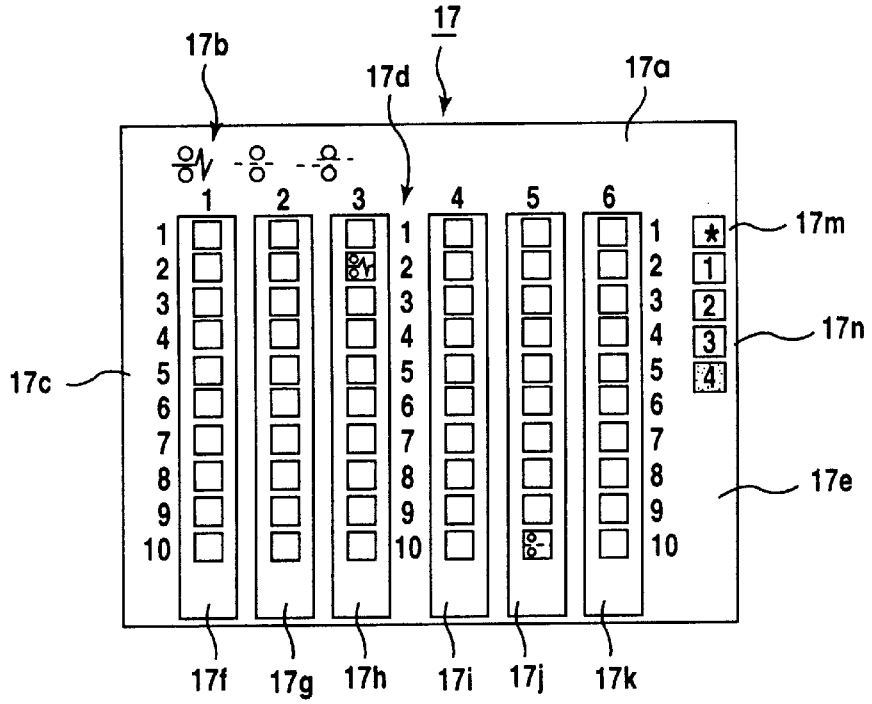
FIG. 4 is a schematic plan view showing another operating state of the display unit illustrated in FIG. 3.

With reference to FIGS. 3 and 4, the operation of the display unit 17 will be described below. In FIGS. 3 and 4, the operating switches 17*n* having the number 1 to 4 correspond to the sheet bundles loaded on the erroneous collated sheet discharging tray 31, respectively. More specifically, the operating switches 17*n* having the numbers 1 to 4 correspond to sheet bundles D to A shown in FIG. 2, respectively.

FIG. 3 shows a state in which the operating switch 17*n* having the number 1 is operated. In FIG. 3, it is displayed that double sheets are generated in the seventh sheet supply shelf of the fifth sheet collating device for the uppermost sheet bundle D loaded on the erroneous collated sheet discharging tray 31 in FIG. 2.

FIG. 4 shows a state in which the operating switch 17*n* having the number 4 is operated. In FIG. 3, it is displayed that multiple sheets are generated in the third sheet supply shelf of the third sheet collating device and missing sheets are generated in the tenth sheet supply shelf of the fifth sheet collating device for the lowermost sheet bundle A loaded on the erroneous collated sheet discharging tray 31 in FIG. 2.

Thus, every time the sheet feeding errors are generated, the contents of the sheet feeding errors are recorded in a memory of the controller. Therefore, if a plurality of sheet feeding errors are generated for one sheet bundle, the sheet collating device and the sheet supply shelf in which the sheet feeding errors are generated are specified. Therefore, it is possible to perform a proper process such as the supplement of insufficient sheets or the removal of the multiple sheets.

In the embodiment shown in FIG. 7, the sheet loading device 21 is provided with the erroneous collated sheet discharging tray 31 on which only the sheet bundles having the sheet feeding errors are loaded. Therefore, also in the case where the sheet feeding errors are generated in the sheet collating device, the collating operation is not stopped but the collated sheet bundles are loaded on the sheet receiving section 23. Consequently, the use efficiency of the sheet collating device can be enhanced. In the embodiment shown in FIG. 7, a single sheet collating device can also be provided in place of the coupled sheet collating devices. Also in this case, the same display unit as shown in FIGS. 3 and 4 can be used in the same manner as in FIG. 5.

Figure 8:
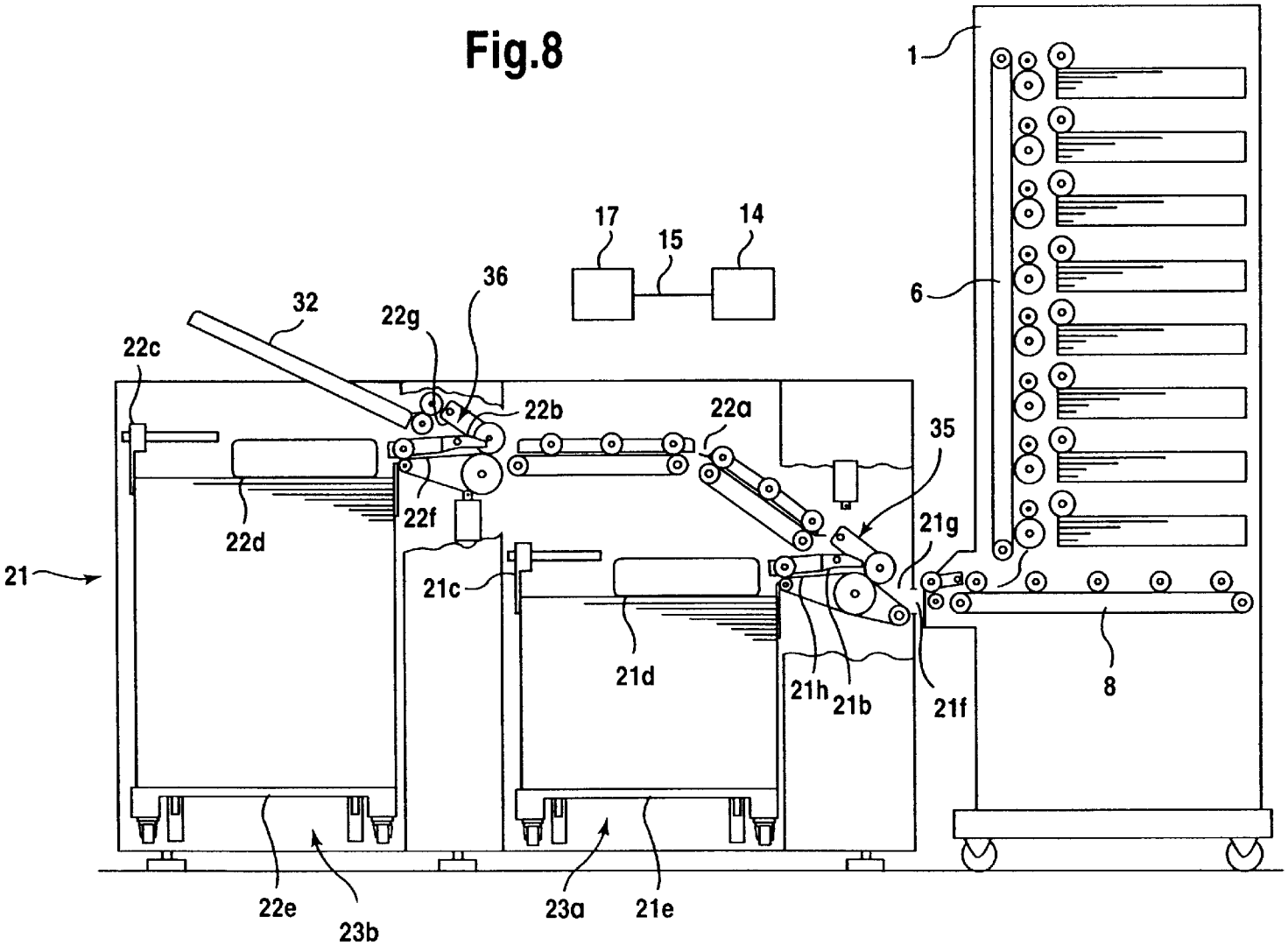
FIG. 8 is a schematic side view showing a collator system according to yet another embodiment of the present invention.

FIG. 8 is a side view showing a collator system according to another embodiment of the present invention. In the embodiment shown in FIG. 8, a sheet loading device 21 comprises two sheet bundle receiving sections 23*a* and 23*b*. A delivery path includes a main delivery path section extending from a sheet feeding port 21*f* to a first branch point 35, a first delivery path section 21*h* extending from the first branch point 35 to a first sheet bundle receiving section 23*a*, a second delivery path section 22*a* extending from the first branch point 35 to a second branch point 36, a third delivery path section 22*f* extending from the second branch point 36 to a second sheet bundle receiving section 23*b*, and a fourth delivery path section 22*g* extending from the second branch point 36 to an erroneous collated sheet discharging tray 32. A first switching gate plate 21*b* and a second switching gate plate 22*b* are provided on the first branch point 35 and the second branch point 36, respectively.

In the drawing, the reference numerals 21*c* and 21*d* denote a first stopper and a first sorting mechanism respectively, and the reference numerals 22*c* and 22*d* denote a second stopper and a second sorting mechanism respectively.

While a normal collating operation is being performed, a controller 14 fixes the second switching gate plate 22*b* to the third delivery path section 22*f* all the time, causes the first switching gate plate 21*b* to operate, switches the delivery path for the sheet bundles into the first delivery path section 21*h* and the second delivery path 22*a*, thereby alternately loading the sheet bundles on the first sheet bundle receiving section 23*a* and the second sheet bundle receiving section 23*b*. In this case, the first sorting mechanism 21*d* and the second sorting mechanism 22*d* are operated. As shown in FIG. 9, the sheet bundles are sorted into two sets and loaded on the sheet bundle receiving sections 23*a* and 23*b*.

When sheet feeding errors occur, the controller 14 switches the first switching gate plate 21*b* into the second delivery path section 22*a* side and the second switching gate plate 22*b* into the third delivery path section 22*f* side. As a result, the sheet bundles having the sheet feeding errors are loaded on the erroneous collated sheet discharging tray 32. Thus, even if the sheet feeding errors occur, the sheet collating device continues its operation without stopping.

In this case, a plurality of sheet collating devices may be coupled in the same manner as in the fifth and seventh embodiments. In the embodiment shown in FIG. 8, the operation of a display unit 17 is the same as in the embodiment shown in FIG. 7.

What is claimed is:

1. A collator system having a sheet feeding error display function, comprising a sheet collating device (1*a*) in which a plurality of sheet supply shelves (2*a*–2*h*) are provided, a stack of sheets to be collated are supported on each sheet supply shelf (2*a*–2*h*), the sheets are fed one by one from each sheet supply shelf (2*a*–2*h*) to a collating section (6*a*) for each collating operation and one sheet bundle is thus collated, a sheet loading device (21) for receiving the sheet bundle collated from the sheet collating device (1*a*), a controller (14) for controlling operations of the sheet collating device (1*a*) and the sheet loading device (21), sheet feeding error detecting means provided on each sheet supply shelf (2*a*–2*h*) of the sheet collating device (1*a*), and a sheet feeding error display unit (17) connected to the controller (14), wherein when sheet feeding errors are detected by the sheet feeding error detecting means, an error detection signal is output from the sheet feeding error detecting means to the controller (14) so that the controller (14) outputs a stop signal to the sheet collating device (1*a*) and causes the sheet feeding error display unit (17) to operate, characterized in that when the sheet feeding errors are detected by the sheet feeding error detecting means, the controller (14) outputs the stop signal to the sheet collating device (1*a*) and continues the collating operation which is being performed during the sheet feeding error detection but stops the collating operation to be started after the sheet feeding error detection, and displays, by switching, the sheet supply shelf where the sheet feeding errors occur and the contents of the sheet feeding errors on the same display screen of the sheet feeding error display unit (17) for each collating operation performed after the stop signal is output and before the collating operation of the sheet collating device (1*a*) is completely ended.

2. The collator system having a sheet feeding error display function according to claim 1, characterized in that a plurality of sheet collating devices (1*a*–1*n*) are coupled and one sheet bundle is collated by a series of the sheet collating devices (1*a*–1*n*) and is transferred to the sheet loading device (21) for each collating operation, and that when the sheet feeding errors are detected, the controller (14) displays, by switching, the sheet collating device and sheet supply shelf where the sheet feeding errors occur and the contents of the sheet feeding errors on the same display screen of the sheet feeding error display unit (17) for each collating operation performed after the stop signal is output and before the collating operations of the series of sheet collating devices (1*a*–1*n*) are completely ended.

3. The collator system having a sheet feeding error display function according to claim 1 or 2, characterized in that a sheet feeding mechanism including a sheet feeding roller (4*a*–4*h*) is provided between the sheet supply shelf (2*a*–2*h*) and the collating section (6*a*–6*n*) in the sheet collating device (1*a*–1*n*) and that the sheet feeding error detecting means comprises a sensor (12*a* 12*h*) provided in the vicinity of the sheet feeding roller (4*a*–4*h*) for detecting the sheet passing through the sheet feeding roller (4*a*–4*h*) and for generating a sheet detection signal while the sheet passes through the sheet feeding roller (4*a*–4*h*), a pulse generator (25) for generating a series of clock pulses according to a sheet feeding operation of the sheet feeding mechanism, a counter (26*a*–26*h*) for counting the number of pulses generated by the pulse generator (25) for the collating operation, a comparator (27*a*–27*h*) for generating a detection timing signal when the counter (26*a*–26*h*) counts a pulse number which is greater than a preset pulse number, and a detector (28*a*–28*h*) for outputting an error detection signal based on the sheet detection signal sent from the sensor (12*a*–12*h*) and the detection timing signal sent from the comparator (27*a*–27*h*), and that the controller (14) comprises a CPU (33), and a memory (34) for recording sheet feeding error information for each collating operation which is performed after the stop signal is output and before the collating operation of the sheet collating device (1*a*–1*n*) is completely ended based on the error detection signal sent from the detector (28*a*–28*h*).

4. A collator system having a sheet feeding error display function, comprising a sheet collating device (1*a*) in which a plurality of sheet supply shelves (2*a*–2*h*) are provided, a stack of sheets to be collated are supported on each sheet supply shelf (2*a*–2*h*), the sheets are fed one by one from each sheet supply shelf (2*a*–2*h*) to a collating section (6*a*) for each collating operation and one sheet bundle is thus collated, a sheet loading device (21) including a sheet bundle feeding port (21*f*) and a sheet bundle receiving section (23) for loading sheet bundles and serving to deliver the sheet bundles sequentially fed from the sheet collating device (1*a*) to the sheet bundle feeding port (21*f*) to the sheet bundle receiving section (23) through a delivery path (21*g*, 21*h*, 21*i*), a controller (14) for controlling operations of the sheet collating device (1*a*) and the sheet loading device (21), sheet feeding error detecting means provided on each sheet supply shelf (2*a*–2*h*) of the sheet collating device (1*a*), and a sheet feeding error display unit (17) connected to the controller (14), wherein when sheet feeding errors are detected by the sheet feeding error detecting means, an error detection signal is output from the sheet feeding error detecting means to the controller (14) so that the controller (14) causes the sheet feeding error display unit (17) to operate, characterized in that the sheet loading device (21) further includes an erroneous collated sheet discharging tray (31), the delivery path (21*g*, 21*h*, 21*i*) has a main delivery path section (21*g*) extending from the sheet feeding port (21*f*) to a branch point (35), a first delivery path section (21*h*) extending from the branch point (35) to the sheet bundle receiving section (23), and a second delivery path section (21*i*) extending from the branch point (35) to the erroneous collated sheet discharging tray (31), the branch point (35) is provided with a switching gate plate (21*b*) for operating in such a manner that the main delivery path section (21*g*) is selectively connected to the first delivery path section (21*h*) or the second delivery path section (21*i*), and that the controller (14) causes the switching gate plate (21*b*) to operate in such a manner that the main delivery path section (21*g*) is connected to the first delivery path section (21*h*) while sheets are normally fed, and causes the switching gate plate (21*b*) to operate in such a manner that the main delivery path section (21*g*) is connected to the second delivery path section (21*i*) when sheet feeding errors are detected by the sheet feeding error detecting means, and the controller (14) further displays, by switching, the sheet supply shelf where the sheet feeding errors occur and the contents of the sheet feeding errors on the same display screen of the sheet feeding error display unit (17) for each sheet bundle loaded on the erroneous collated sheet discharging tray (31).

5. The collator system having a sheet feeding error display function according to claim 4, characterized in that a plurality of sheet collating devices (1*a*–1*n*) are coupled and one sheet bundle is collated by a series of the sheet collating devices (1*a*–1*n*) and is transferred to the sheet loading device (21) for one collating operation, and the controller (14) displays, by switching, the sheet collating device and sheet supply shelf where the sheet feeding errors occur and the contents of the sheet feeding errors on the same display screen of the sheet feeding error display unit (17) for each sheet bundle loaded on the erroneous collated sheet discharging tray (31).

6. The collator system having a sheet feeding error display function according to claim 4 or 5, characterized in that a sheet feeding mechanism including a sheet feeding roller (4*a*–4*h*) is provided between the sheet supply shelf (2*a*–2*h*) and the collating section (6*a*–6*n*) in the sheet collating device (1*a*–1*n*) and that the sheet feeding error detecting means comprises a sensor (12*a*–12*h*) provided in the vicinity of the sheet feeding roller (4*a*–4*h*) for detecting the sheet passing through the sheet feeding roller (4*a*–4*h*) and for generating a sheet detection signal while the sheet passes through the sheet feeding roller (4*a*–4*h*), a pulse generator (25) for generating a series of clock pulses according to a sheet feeding operation of the sheet feeding mechanism, a counter (26*a*–26*h*) for counting the number of pulses generated by the pulse generator (25) for the collating operation, a comparator (27*a*–27*h*) for generating a detection timing signal when the counter (26*a*–26*h*) counts a pulse number which is greater than a preset pulse number, and a detector (28*a*–28*h*) for outputting an error detection signal based on the sheet detection signal sent from the sensor (12*a*–12*h*) and the detection timing signal sent from the comparator (27*a*–27*h*), and that the controller (14) comprises a CPU (33), and a memory (34) for recording sheet feeding error information based on the error detection signal sent from the detector (28*a*–28*h*).

* * * * *